US006079589A

United States Patent [19]

Matsuyama et al.

[11] Patent Number: 6,079,589

[45] Date of Patent: Jun. 27, 2000

[54] DRINKING RECEPTACLE COVERS

[75] Inventors: Shin Matsuyama; Shoji Toida; Yasuhiro Kowa; Toru Goto; Rikiya Kato, all of Tokyo, Japan

[73] Assignee: Nippon Sanso Corporation, Tokyo, Japan

[21] Appl. No.: 09/260,486

[22] Filed: Mar. 2, 1999

[30] Foreign Application Priority Data

Mar. 4, 1998 [JP] Japan ..... 10-051826

[51] Int. Cl.[7] ..... A47G 19/22

[52] U.S. Cl. ..... 220/715; 220/373; 220/375; 215/306; 215/387; 222/525

[58] Field of Search ..... 220/705, 714, 220/715, 718, 373, 375; 215/387, 388, 389, 306, 309, 311, 11.4, 11.5; 222/525

[56] References Cited

U.S. PATENT DOCUMENTS 714,133 11/1902 Blatin ..... 215/11.4 X
5,022,562 6/1991 Lurkis et al. ..... 222/182
5,029,719 7/1991 Solomon ..... 215/229
5,048,705 9/1991 Lynd et al. ..... 215/388
5,079,013 1/1992 Belanger ..... 215/11.4 X
5,088,948 2/1992 Scheurer ..... 215/388 X
5,706,973 1/1998 Robbins, III et al. ..... 220/714
5,890,620 4/1999 Belcastro ..... 220/714

*Primary Examiner*—Stephen K. Cronin
*Attorney, Agent, or Firm*—Armstrong, Westerman, Hattori, McLeland & Naughton

[57] ABSTRACT

A drinking receptacle cover to be removably applied to an opening of a receptacle main body. This cover has on its top plate a drinking spout which can be shut off and a negative pressure relief valve. The spout contains a drinking spout main body which protrudes from the top plate and has a channel; a drinking spout portion which is fitted on the drinking spout main body to be shiftable in the axial direction so as to open and close the channel; and a drinking spout cap which can be removably applied to the drinking spout portion; and the channel can be opened and closed by the shift of the drinking spout portion which occurs with fitting and removal of the drinking spout cap.

3 Claims, 4 Drawing Sheets

DRINKING RECEPTACLE COVERS

TECHNICAL FIELD

The present invention relates to a drinking receptacle cover.

BACKGROUND ART

Generally, a portable drinking receptacle basically consists of a receptacle main body, an inner stopper and a cover serving also as a cup. Both the inner stopper and the cover are fitted on the main body. If one is to drink water directly from the receptacle main body, he or she takes off the cover and the inner stopper and drinks the water with his or her mouth applied to an opening of the receptacle main body. Thus, since the procedures of removing the cover and the inner stopper are troublesome, and since it is inconvenient to take off them when one wants to drink the water in haste during sporting and the like or when one is exercising, water bottles (canteens) having drinking spouts are available so as to cope with uses in such occasions.

Some of such water bottles include those of the structure in which the cap of the bottle is equipped with a drinking spout, and the barrel of the bottle main body is designed to be squeezed and deformed so as to prevent reduction in the internal pressure of the bottle main body from occurring when the water in the bottle is being drunk. Meanwhile, there is another structure, as disclosed in Japanese Utility Model Publication No. Hei 1-27699, in which the water bottle is equipped with a cover having a drinking spout, which can be housed in the cover when the water bottle is not used and which can be pulled out of the cover when the water bottle is used under a pivotal motion of an operating part, and an air vent for preventing reduction in the internal pressure of the bottle main body from occurring, so that the drinking spout may be folded and shut off itself and the air vent when the water bottle is not used.

However, the former water bottle requires a squeezing force for deforming the bottle main body; whereas in the latter water bottle, the structure of folding the drinking spout and that of opening and closing the air vent are complicated.

SUMMARY OF THE INVENTION

It is an objective of the present invention to provide a drinking receptacle cover which facilitates the procedures of opening and closing the drinking spout to allow drinking of the water easily.

The drinking receptacle cover according to the present invention has on its top plate a drinking spout which can be shut off and a negative pressure relief valve. Accordingly, if one sucks the water contained in the drinking receptacle through the drinking spout with the receptacle being tilted, the atmospheric air flows through the negative pressure relief valve into the receptacle main body to prevent the internal pressure of the receptacle from being reduced, enabling drinking of the water easily.

Further, the drinking spout contains a drinking spout main body which protrudes from the top plate and has a channel, a drinking spout portion which is fitted on the drinking spout main body to be shiftable in the axial direction so as to open and close the channel, and a drinking spout cap which can be removably applied to the drinking spout portion, and the channel can be opened and closed by the shift of the drinking spout portion which occurs with fitting and removal of the drinking spout cap. Accordingly, the procedures of opening and closing the channel can be carried out easily using only one hand or mouth.

MODE FOR CARRYING OUT THE INVENTION

Figure 1:
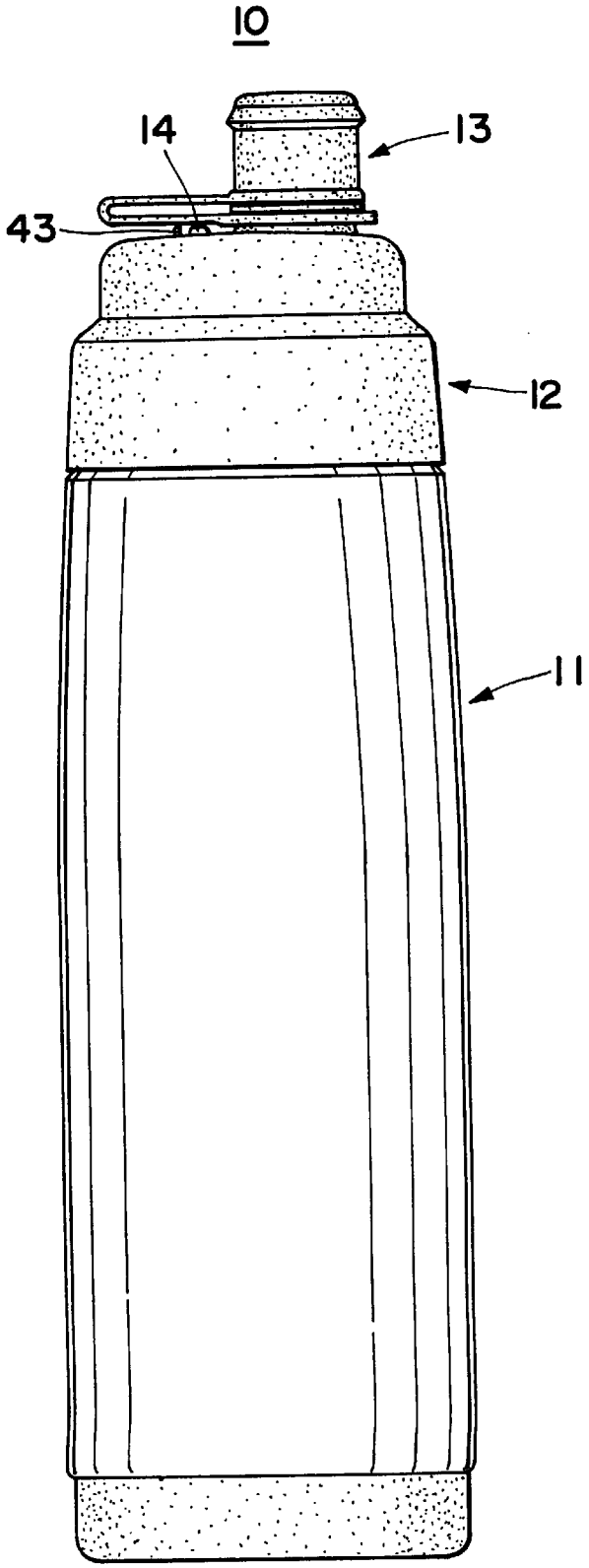
FIG. 1 is a front view of the drinking receptacle according to a first embodiment of the present invention.

The embodiments of the present invention will be described below specifically referring to the drawings.

Figure 2:
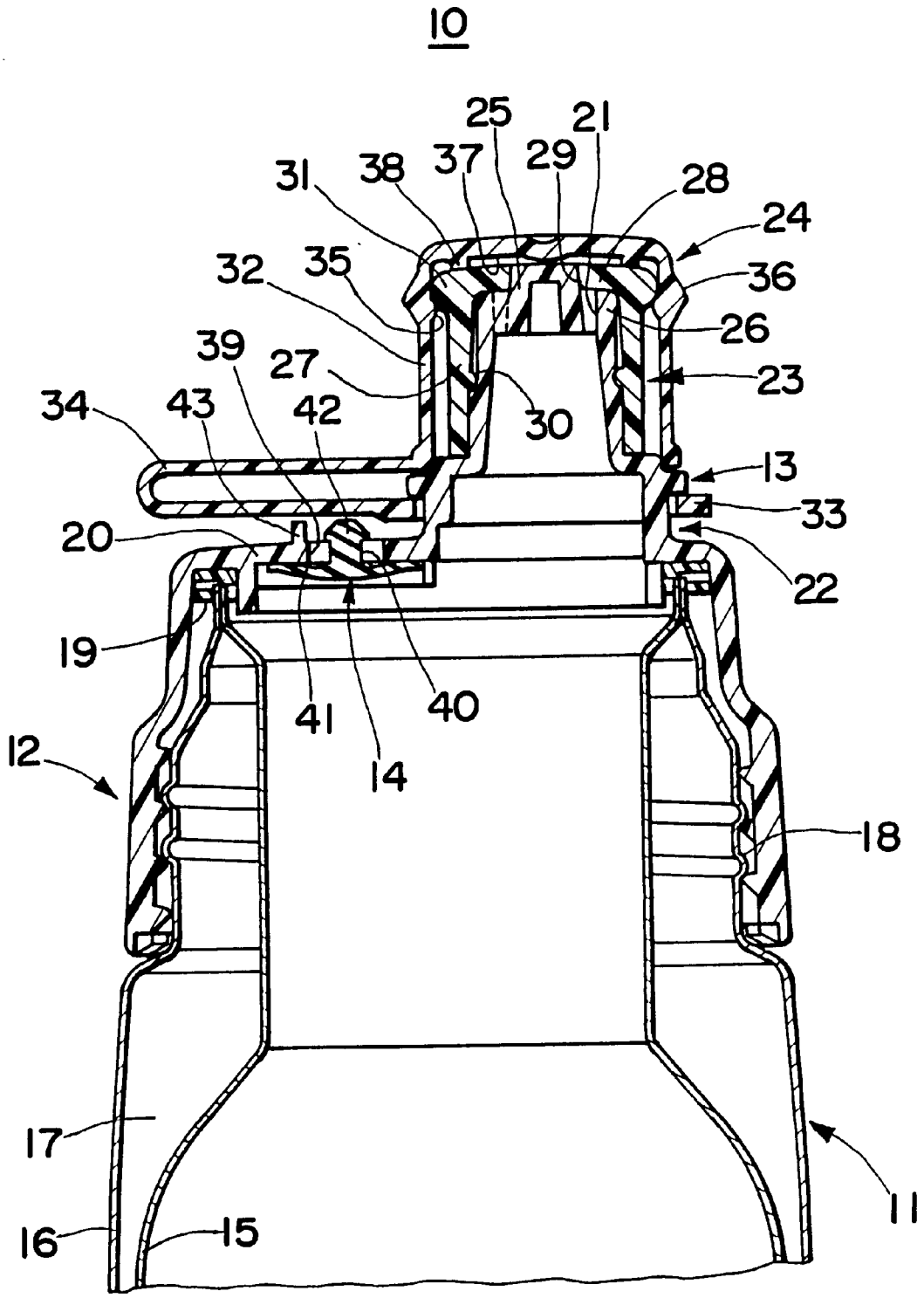
FIG. 2 is a cross-sectional view showing the upper half of the drinking receptacle shown in FIG. 1.
Figure 3:
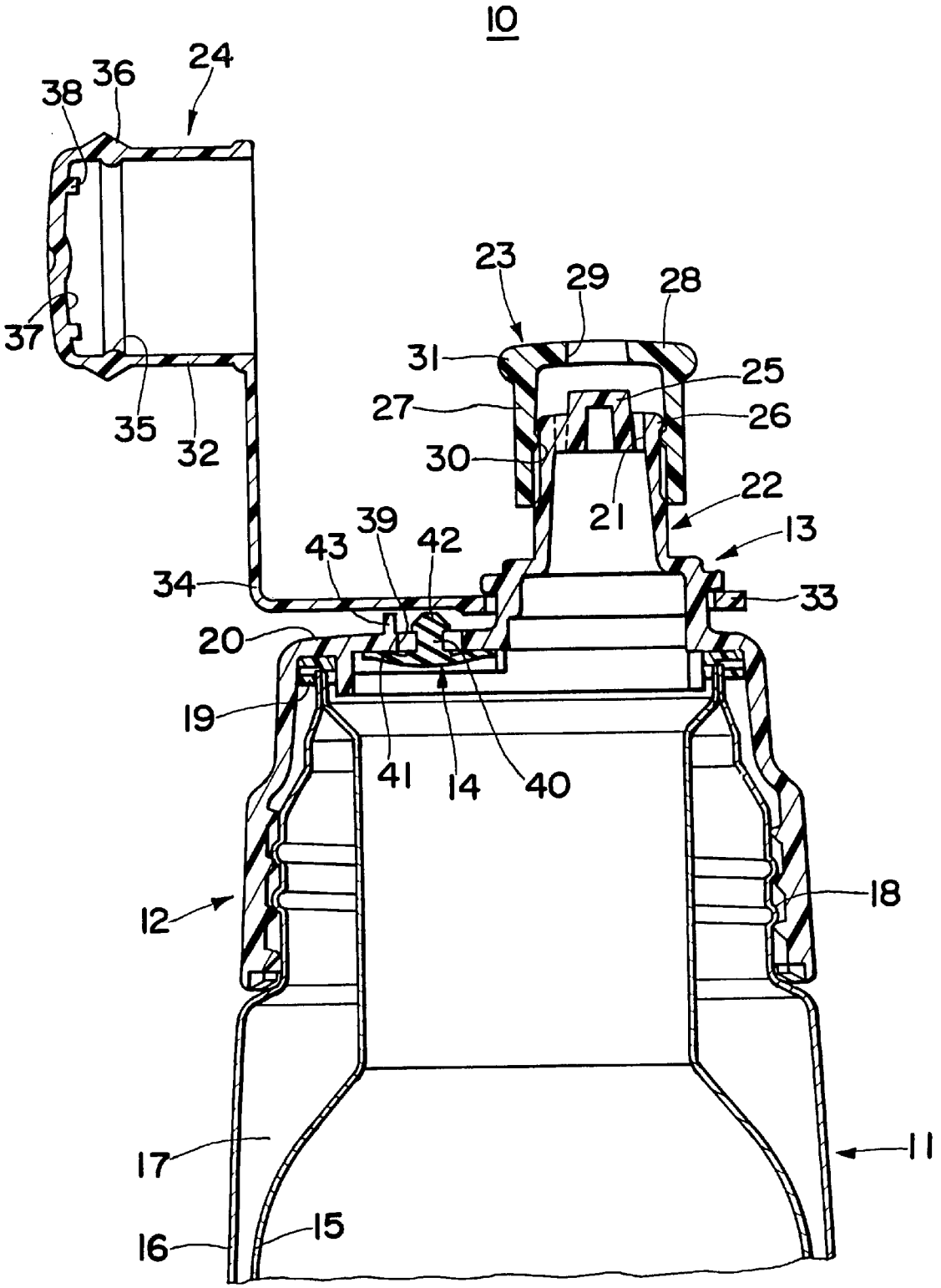
FIG. 3 is a cross-sectional view showing also the upper half of the drinking receptacle with the drinking spout cap being taken off.

FIGS. 1 to 3 show the first embodiment of the present invention, in which a drinking receptacle 10 contains a receptacle main body 11 and a cover 12 to be removably applied to an opening of the receptacle main body 11. The cover 12 has a drinking spout 13 which can be shut off and a negative pressure relief valve 14.

The receptacle main body 11 is formed by joining a metallic closed-bottom inner barrel 15 and a metallic closed-bottom outer barrel 16 at their upper end openings, and a heat-insulating section 17 having a vacuum heat-insulating structure is defined between the barrel 15 and the barrel 16, as shown in FIGS. 2 and 3. The outer barrel 16 has a threaded portion 18 formed on the outer circumference of the upper end portion to which the cover 12 is screw-fitted. Incidentally, the inner barrel 15 and the outer barrel 16 may be made of a synthetic resin. Further, the heat-insulating section 17 may be of a heat-insulating structure filled with a low-thermal conductivity gas, a heat-insulating structure filled with an inorganic filler, a heat-insulating structure filled with an organic filler such as styrofoam, and the like.

The cover 12 has on its top plate 20 the drinking spout 13 protruding therefrom and the negative pressure relief valve 14. The top plate 20 has along the inner periphery a packing 19 which is brought into intimate contact with the mouth of the opening of the receptacle main body 11.

The drinking spout 13 contains a cylindrical drinking spout main body 22 having a channel 21 and rising from one side of the top plate 20; a drinking spout portion 23 which is fitted on the drinking spout main body 22 to be shiftable along it in the axial direction so as to open and close the channel 21; and a drinking spout cap 24 which can be removably applied to the drinking spout portion 23.

The drinking spout main body 22 has a columnar guide 25 formed at the center of the upper end, with a plurality of small through holes being formed as the channel 21 around the guide 25, and also has a stopping rim 26 formed to protrude from the upper end along the periphery.

The drinking spout portion 23 is formed by combining a cylindrical body 27 with a top face 28; defining, at the center of the top face 28, a through hole 29 to which the guide 25 is inserted; forming an annular ridge 30, which is engaged with the stopping rim 26, along the inner circumference of the cylindrical body 27 at the middle portion, and forming an engaging portion 31, with which the drinking spout cap 24 is engaged, along the outer circumference at the upper part of the cylindrical body 27.

In this drinking spout portion 23, the through hole 29 is shut off by the guide 25, and the channel 21 is closed by the inner side peripheral portion of the through hole 29 of the top face 28, in the state where the top face 28 is brought into contact with the top face of the drinking spout main body 22. When the drinking spout portion 23 is shifted up, the top face 28 is spaced away from the channel 21 to open it and also to carry the through hole 29 away from the guide 25 to be open.

The drinking spout cap 24 basically consists of a cap portion 32 to be fitted on the drinking spout portion 23, a retaining ring 33 to be attached to the proximal portion of the drinking spout main body 22 and a retaining belt 34 which connects the cap portion 32 with the retaining ring 33 and can be bent into a U shape. The cap portion 32 has an engaging portion 35 to be engaged with the engaging portion 31 of the drinking spout portion 23 and a flange 36, which catches fingers when the cap portion 32 is pulled off, formed along the upper inner circumference and along the upper outer circumference, respectively. A continuous annular ridge 38, which pushes the top face 28 of the drinking spout portion 23 when the cap portion 32 is applied to the drinking spout portion 23, is formed on the inner side periphery of a top face 37 of the cap portion 32. Incidentally, this ridge 38 may be formed fragmentarily.

On the other side of the top plate 20 of the cover 12, is formed a slit-like air vent 39 for preventing reduction in the internal pressure of the receptacle main body 11 from occurring, and the negative pressure relief valve 14 is located in the air vent 39. The negative pressure relief valve 14 has a valve stem 40 inserted to the air vent 39, a valve element 41 located on the lower end of the valve stem 40 and a stopping end portion 42 formed on the upper end of the valve stem 40. This negative pressure relief valve 14 is attached to the top plate 20 by inserting the valve stem 40 from the inside of the receptacle main body 11 into the air vent 39 such that the stopping end portion 42 may protrude to the outer side of the top plate 20 and that the valve element 41 may be brought into intimate contact with the inner side of the top plate 20 to be able to open and close the air vent 39 with the valve element 41 from the inside of the receptacle main body 11. The valve element 41 flexes when the internal pressure of the receptacle main body 11 is reduced to open the air vent 39, and closes the air vent 39 when the internal pressure of the receptacle main body 11 is returned to atmospheric pressure or when the pressure of the water in the receptacle main body 11 is exerted to the valve element 41. Incidentally, the top plate 20 of the cover 12 has on the outer side an annular ridge 43 surrounding the air vent 39. This ridge 43 is formed to surround partly or entirely the air vent 39 so that the retaining belt 34 of the drinking spout cap 24 located above the stopping end portion 42 of the negative pressure relief valve 14 may not be brought into contact with that portion 42.

In the thus constituted drinking receptacle 10, in the state where the drinking spout cap 24 is applied to the drinking spout portion 23 of the drinking spout 13 as shown in FIG. 2, the top face 28 of the drinking spout portion 23 is brought into contact with the upper side of the drinking spout main body 22 to shut off the through hole 29 of the drinking spout portion 23 with the guide 25 of the drinking spout main body 22 and also to close the channel 21 of the drinking spout main body 22 with the peripheral portion of the through hole 29. Further, the air vent 39 is closed by the valve element 41 of the negative pressure relief valve 14.

When the flange 36 of the drinking spout cap 24 is pulled up by the hand or mouth, the drinking spout portion 23 is pulled up together with the drinking spout cap 24 due to the engagement between the engaging portion 35 of the drinking spout cap 24 and the engaging portion 31 of the drinking spout portion 23 to shift up the drinking spout portion 23 along the drinking spout main body 22 until the annular ridge 30 of the drinking spout portion 23 is engaged with the stopping rim 26 of the drinking spout main body 22. Then, the engaging portion 35 of the drinking spout cap 24 rides over the engaging portion 31 of the drinking spout portion 23 to release the drinking spout cap 24 from the drinking spout portion 23, as shown in FIG. 3. Thus, the through hole 29 of the drinking spout portion 23 and the channel 21 of the drinking spout main body 22 are opened.

If one holds the drinking receptacle 10 tilted such that the drinking spout 13 may locate on the lower side and sucks the water with his or her mouth applied to the drinking spout portion 23, the internal pressure of the drinking receptacle 10 is reduced, and the valve element 41 of the negative pressure relief valve 14 flexes to open the air vent 39 and allow the outside air to flow into the drinking receptacle 10. Thus, the internal pressure of the drinking receptacle 10 is prevented from being reduced, and the water in the drinking receptacle 10 can be drunk through the through hole 29 via the channel 21. In this case, since the drinking receptacle 10 is tilted, the air vent 39 locates upper than the drinking spout 13 to scarcely cause soaking of the air vent 39 with the water and leakage of the water through the air vent 39.

Accordingly, the water in the drinking receptacle 10 having rigidity and high heat-insulating properties can be drunk readily. Further, since the through hole 29 of the drinking spout portion 23 and the channel 21 of the drinking spout main body 22 are designed to be opened and closed by shifting up and down the drinking spout portion 23 with opening and closing of the drinking spout cap 24, the opening and closing procedures can be carried out using only one hand or mouth. In addition, since the annular ridge 38 for pushing the top face 28 of the drinking spout portion 23 is formed on the inner side of the top face 37 of the drinking spout cap 24, the top face 28 of the drinking spout portion 23 is securely pushed by them, in the procedure of closing the cap 24, to close the through hole 29 and the channel 21. Besides, the retaining belt 34 of the drinking spout cap 24 is prevented by the ridge 43 formed on the outer side of the top plate 20 of the cover 12 from being brought into contact with the stopping end portion 42 of the negative pressure relief valve 14, so that the negative pressure relief valve 14 does not slip off the top plate 20 of the cover 12, and that the water in the drinking receptacle 10 scarcely leaks. Furthermore, since the negative pressure relief valve 14 is attached to the top plate 20 of the cover 12 to close the air vent 39 when the pressure of water in the drinking receptacle 10 is exerted to the valve 14, the water in the drinking receptacle 10 leaks hardly even if the drinking receptacle 10 is laid horizontally or turned over.

Figure 4:
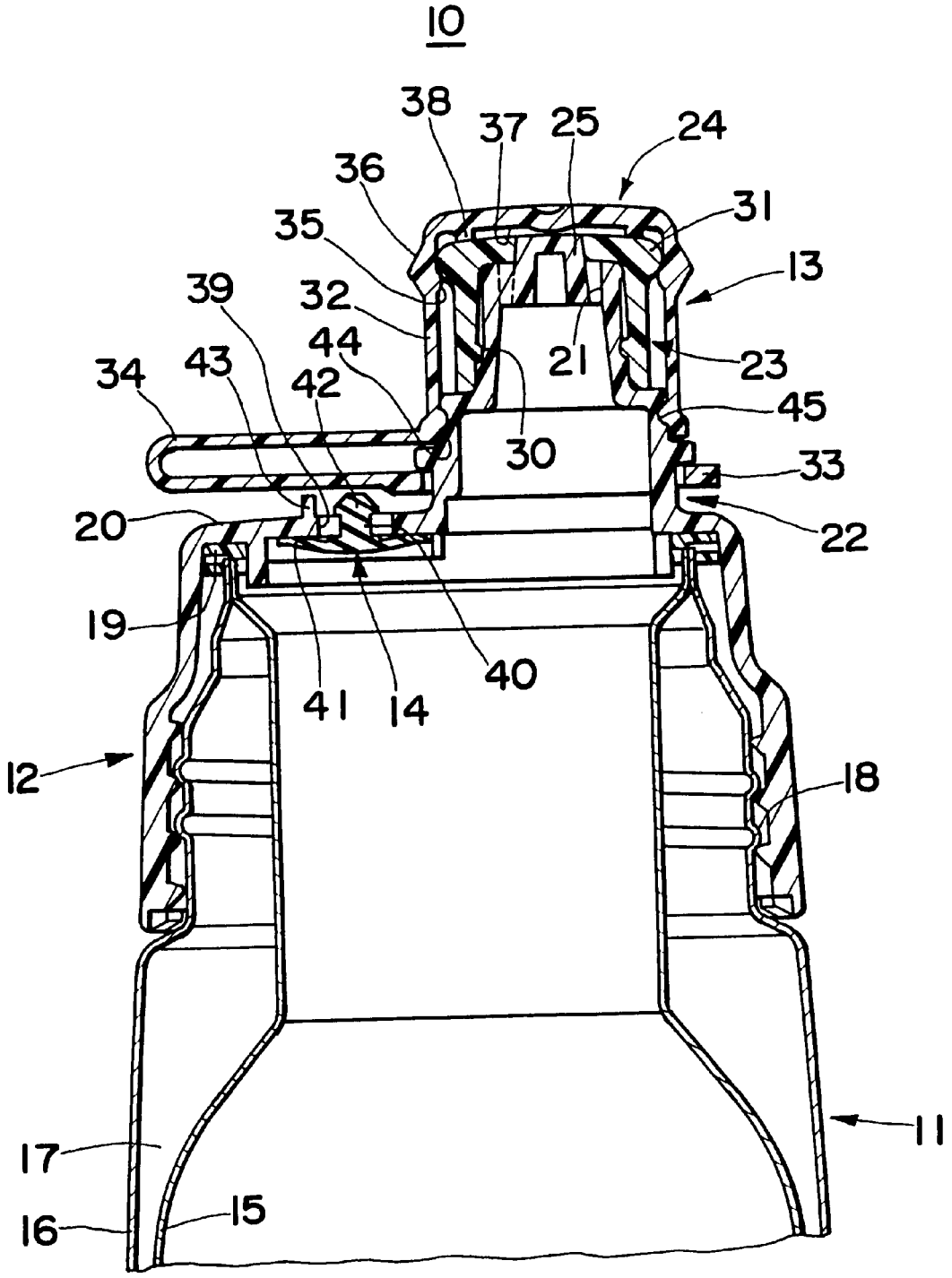
FIG. 4 is a cross-sectional view showing the upper half of the drinking receptacle according to a second embodiment of the present invention.

FIG. 4 shows the second embodiment of the present invention. It should be noted here that like or same elements as in the first embodiment are affixed with the same reference numbers respectively, and detailed descriptions of them will be omitted.

In this embodiment, an annular ridge 44 is formed along the inner lower circumferential edge of the drinking spout cap 24 so that the annular ridge 44 may be engaged with an engaging groove 45 formed on the drinking spout main body 22 when the cap portion 32 is applied to the drinking spout portion 23. Thus, the cap portion 32 can securely be engaged with the drinking spout main body 22 to allow the cap portion 32 to exhibit water sealing effect.

While the receptacle main bodies employed in the above two embodiments are of heat-insulating structure, those which are not of heat-insulating structure may also be employed.

What is claimed is:

1. A drinking receptacle cover to be removably fitted to an opening of a receptacle main body, the cover comprising a top plate, a drinking spout which can be shut off and a negative pressure relief valve, both the spout and the valve being formed on the top plate, wherein the spout contains a drinking spout main body which protrudes from the top plate and has a channel;

a drinking spout portion which is fitted on the drinking spout main body to be shiftable in the axial direction so as to open and close the channel; and a drinking spout cap which can be removably applied to the drinking spout portion;

the channel being designed to be opened and closed by the shift ot the drinking spout portion which occurs with fitting and removal of the drinking spout cap, the drinking spout portion comprising an engaging portion on its outer circumference, and the drinking spout cap comprising (i) an engaging portion formed on an inner circumference of the drinking spout cap to be engaged with the engaging portion of the drinking spout portion for shifting the drinking spout portion to open the channel when the drinking spout cap is removed, and (ii) an inner side portion of a top face of the drinking spout cap for shifting the drinking spout portion to close the channel when the drinking spout cap is fitted.

2. The drinking receptacle cover as claimed in claim 1, wherein the valve is at least partially surrounded by a ridge.

3. The drinking receptacle cover as claimed in claim 1, wherein an at least fragmentary annular ridge is formed on the inner side periphery of the top face of the drinking spout cap for shifting the drinking spout portion to close the channel when the drinking spout cap is fitted.

* * * * *